US007288188B2

(12) United States Patent
Al-Assfour

(10) Patent No.: US 7,288,188 B2
(45) Date of Patent: Oct. 30, 2007

(54) GROUND WATER COLLECTION SYSTEM

(76) Inventor: Faisal Abdul Aziz Al-Assfour, P.O. Box 1334-code, 32014-Hawally (KW)

( * ) Notice: Subject to any disclaimer, the term of this patent is extended or adjusted under 35 U.S.C. 154(b) by 97 days.

(21) Appl. No.: 11/362,130

(22) Filed: Feb. 27, 2006

(65) Prior Publication Data

US 2007/0199869 A1 Aug. 30, 2007

(51) Int. Cl.
*E03F 5/14* (2006.01)

(52) U.S. Cl. ..... 210/164; 210/170.03; 210/532.1; 210/538; 404/4

(58) Field of Classification Search ..... 210/163, 210/164, 170.03, 521, 538, 532.1; 404/4, 404/5

See application file for complete search history.

(56) References Cited

U.S. PATENT DOCUMENTS 700,056 A * 5/1902 Kremer ..... 210/538
1,041,887 A * 10/1912 Schodde ..... 210/163
1,070,773 A * 8/1913 Callahan ..... 210/164
1,686,415 A * 10/1928 Lyes ..... 210/164
3,066,802 A * 12/1962 Loffler ..... 210/163
3,374,894 A * 3/1968 Webster ..... 210/532.1
5,028,320 A * 7/1991 Gaudin et al. ..... 210/164
5,284,580 A * 2/1994 Shyh ..... 210/163
5,849,181 A * 12/1998 Monteith ..... 210/170.03
2004/0226869 A1* 11/2004 McClure et al. ..... 404/4
2004/0251185 A1* 12/2004 Pitt et al. ..... 210/163

* cited by examiner

*Primary Examiner*—Christopher Upton
(74) *Attorney, Agent, or Firm*—Lowe Hauptman Ham & Berner

(57) ABSTRACT

A storm water collection system including a below ground basin and a grate covering the basin. The system also includes a removable water impermeable receptacle disposed within the basin and an inner housing for directing ground water passing through the grate and to the bottom of the removable receptacle. The receptacle also includes one or more generally rectangular openings in an upper portion thereof so that water that flows through the inner housing and upwardly between the walls of the inner housing and the walls of the receptacle flow out of the openings and down to the bottom of the basin.

7 Claims, 4 Drawing Sheets

GROUND WATER COLLECTION SYSTEM

This invention relates to a ground water collection system and more particularly to a ground water collection that facilitates removal of dirt and debris from a storm basin and for minimizing dirt and debris from accumulating in sewer system.

BACKGROUND FOR THE INVENTION

Catch basins for receiving and discharging surface water from streets into sewers are well known and have been widely used for many years. For example, a U.S. Pat. No. 809,201 of Lutz in 1906 discloses an early catch basin to catch the sediment in surface water and prevent it from being carried into a sewer and clogging up the sewers.

A more recent development in storm water filtration systems is disclosed in U.S. Pat. No. 5,133,619. of Murfae et al. As disclosed therein, a filter assembly for storm water sewer is provided in an alternative run-off path between the ground to be drained and the storm water sewer so that if the filter assembly is flooded, storm water can still drain to the sewer. The filter assembly preferably comprises a metal filter basket removably housed in a basin disposed up stream from a conventional storm water-receiving basin. The basket contains dischargeable filtration media and lifting channels, which enable the basket to be removed from and inserted into a basin by the tines of a conventional waste disposal vehicle.

Another development for refuse collecting in a sewer system is disclosed in a U.S. Pat. No. 5,284,580 of Shyh. As disclosed therein, a refuse collecting frame for a drainage sewer particularly a frame placed beneath a cover of a sewer drainage opening accumulates refuse and permits easy disposal of refuse accumulated therein in order to prevent blockage of the sewer. The refuse collecting frame includes a frame body and a refuse collecting basin. The frame body is preferably a rectangular or cubic frame structure having a dimension corresponding to the opening of a sewer drain. A filtering net or a porous board with a plurality of penetrating holes is incorporated at each lateral sides and bottom of a frame. A plurality of bright angled hangers are formed at spaced positions along the upper edges of an open upper side of the frame for firmly hanging the frame on a sewer opening by positioning the right-angled hangers on a stepped portion formed along edges of the sewer opening beneath a separate cover. A hole of appropriate size is formed at the middle of a filtering net or the porous board at the bottom of the frame body for placing of the collection basin with a peripheral edge of the basin being supported about the circumference of the hole.

Notwithstanding the above, it is presently believed that there may be a commercial market for a ground water collection system in accordance with the present invention. It is believed that there will be a demand because the systems in accordance with the present invention are particularly applicable to those systems in sandy soil areas where large amounts of sandy soil often accumulate in the system together with debris typically carried by ground water into ground water disposal systems.

BRIEF SUMMARY OF THE INVENTION

In essence, the present invention contemplates a water collection system that facilitates removal of dirt, sand and other debris before accumulated surface water reaches a sewer system. The water collection system in accordance with the present invention comprises a conventional below ground water receiving basin with a bottom and four upwardly extending sides and an open top. The invention also contemplates a grate covering the open top of the basin for allowing ground water to run into the basin. The basin, like other conventional basins, includes an outlet to a sewer line. A key element of the present invention resides in a removable box-like receptacle disposed in the basin with a space on each side thereof and an inner housing with an upper flange for directing all of the surface water passing through the grate into the inner housing. The removable box-like receptacle includes a water impermeable bottom and means for positioning the bottom of the box-like receptacle above the bottom of the basin. The receptacle also includes four upwardly extending water impermeable side walls having upper and lower portions and an open top with a handle in an upper portion of two of the water impermeable sides for facilitating removal of the receptacle from the basin. Each of the upperwardly extending sides includes one or two longitudinally extending generally rectangular openings in an upper portion thereof for allowing accumulated water to flow through the openings and down to the bottom of the basin. The system also includes an inner housing having four water impermeable sides with an open top and an open bottom with an outwardly extending upper flange extending around the inner housing and outwardly extending lower flange with a plurality of circular openings therein which is essentially parallel with the outwardly extending upper flange. The inner housing extends downwardly into the receptacle with its upper flange resting on the top of the upperwardly extending side walls of the receptacle, which supports a bottom of the inner housing above the bottom of the receptacle and prevents storm water from falling into the space between the inner housing and the upperwardly extending side walls of the box-like receptacle. The lower flange extends between the inner housing and the upperwardly extending side walls of the box-like receptacle and provides a passageway between the upperwardly extending side walls and the inner housing so that relatively clean storm water rises upwardly in the passage between the side walls of the inner housing and the side walls of the receptacle and out of a longitudinally extending openings and downwardly into the bottom of the basin.

The invention will be described in connection with the accompanying drawings wherein like reference numerals have been used to identify like parts.

DESCRIPTION OF THE PREFERRED EMBODIMENTS OF THE INVENTION

Figure 1:
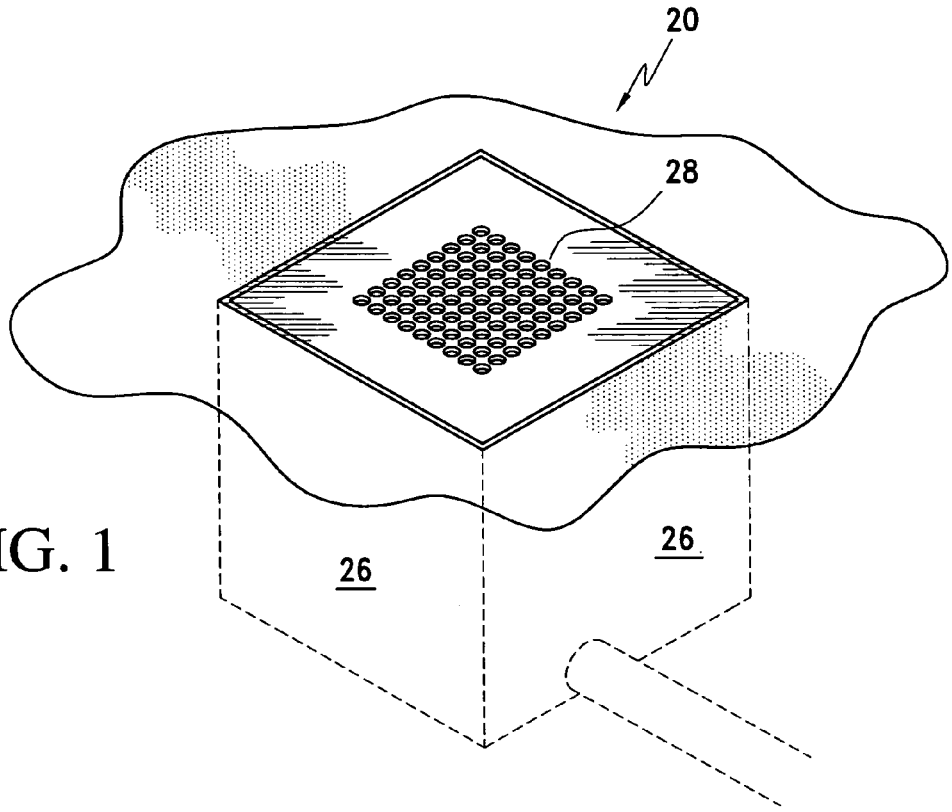
FIG. 1 is a perspective view of a ground water collection system in accordance with the invention.
Figure 2:
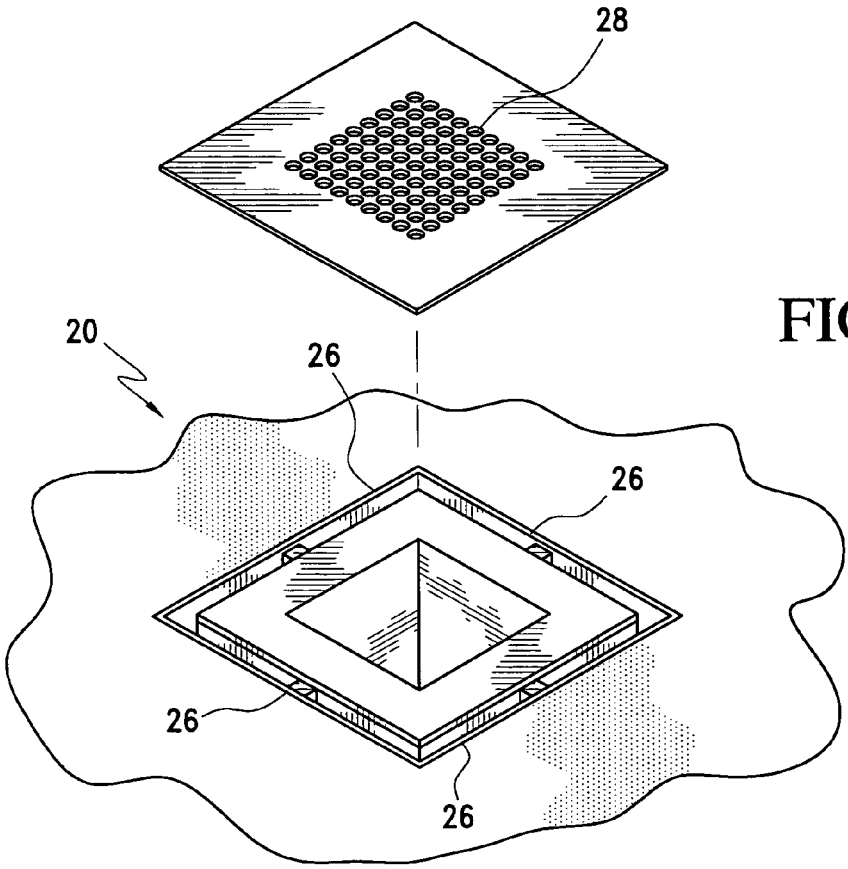
FIG. 2 is a perspective view partially exploded of a top portion of the ground water collection system shown FIG. 1.
Figure 3:
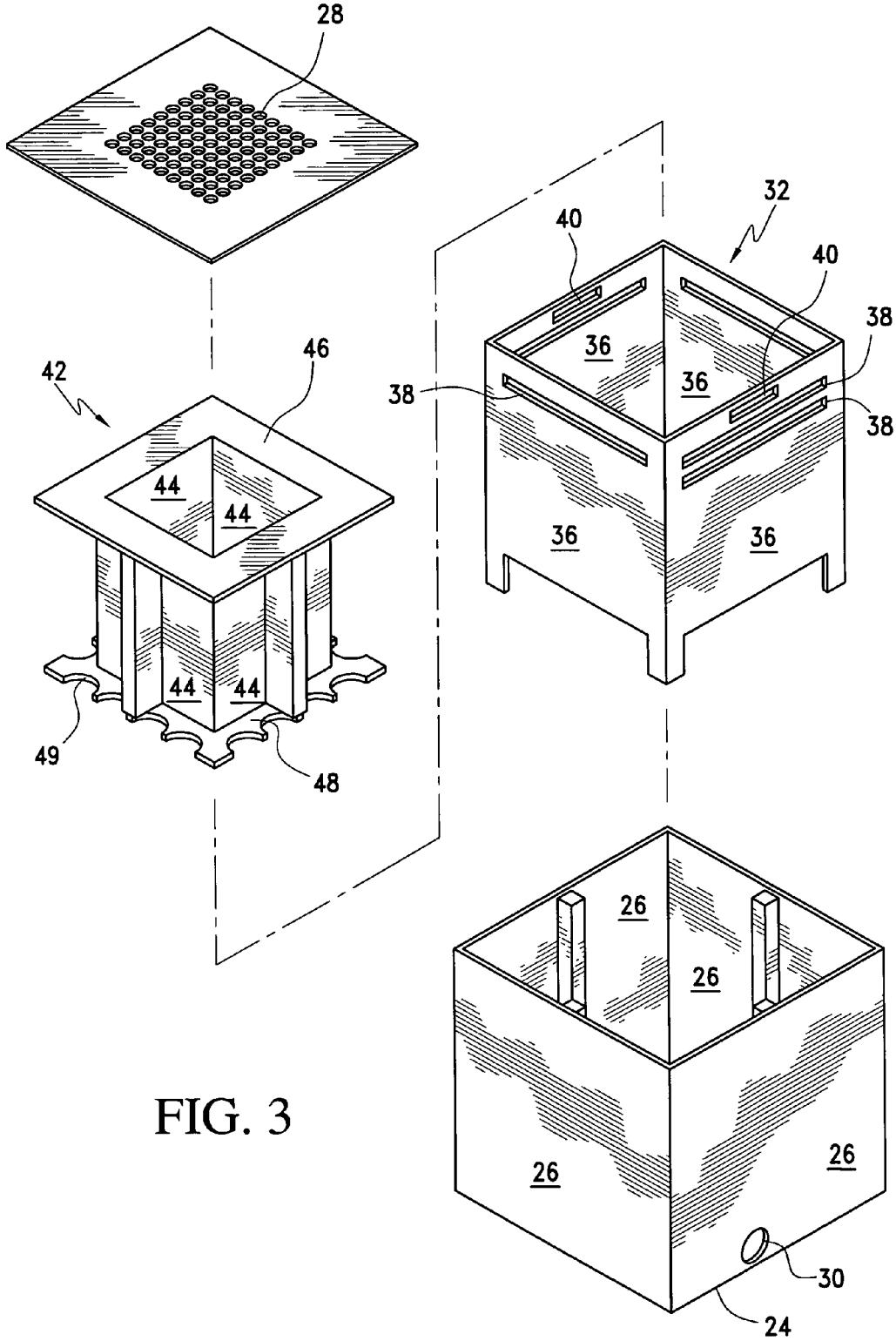
FIG. 3 is an exploded perspective view of the ground water collection shown in FIGS. 1 and 2.

As illustrated in FIGS. 1-4, a water collection system 20 includes a conventional below ground water receiving basin 22 (FIGS. 4 and 5) with a bottom 24 and four upwardly extending sides 26 and an open top. The system also includes a grate 28, which covers the open top of the basin and allows ground water to run into the basin in a conventional manner. The basin 22 like other conventional basins includes an outlet 30 for directing ground water into a sewer line (not shown).

A key element in the present invention resides in a removable box-like receptacle 32 (FIG. 3) that facilitates removal of dirt, sand and other debris from the surface water before it reaches a sewer line and to prevent such material from reaching the sewer line. The box-like receptacle 32 includes a water impermeable bottom 34 and four water impermeable upwardly extending walls 36 and an open top. In a preferred embodiment of the invention, each of the upwardly extending walls includes a pair of generally rectangular elongated openings 38 in an upper portion thereof. The opening 38 are generally parallel with the top and bottom 34 and allow water that reaches that level in the receptacle to flow out of openings 38 and into the basin 22. A handle 40 is also provided in an upper portion of at least two of the upperly extending sidewalls 36 for removing the receptacle 32 from the basin 22 for cleaning. Means 33 such as a plurality of feet or spacers position the receptacle 32 above the bottom 24 of the basin 22.

Figure 4:
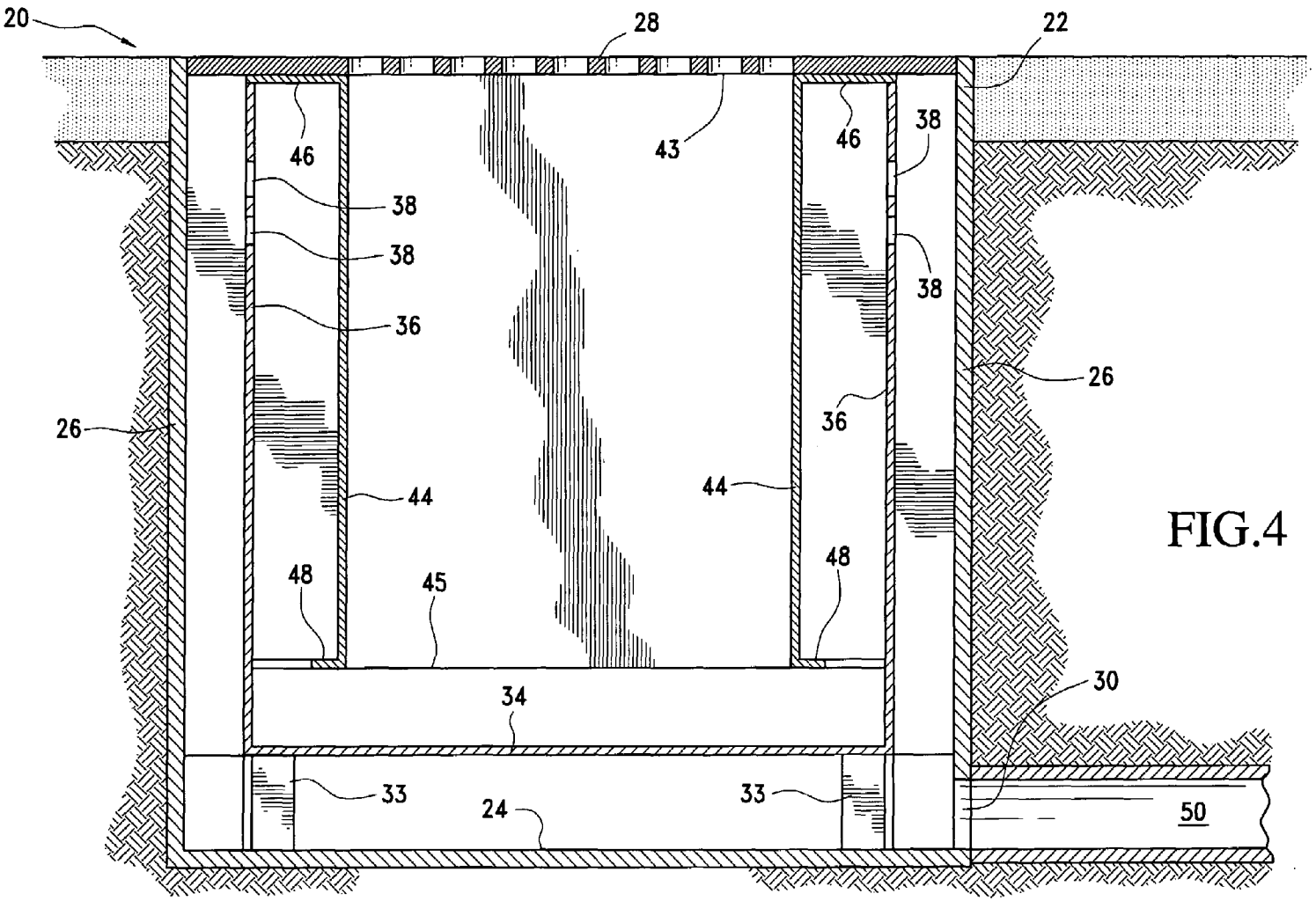
FIG. 4 is a cross-sectional view of a ground water collection system in accordance with the present invention.
Figure 5:
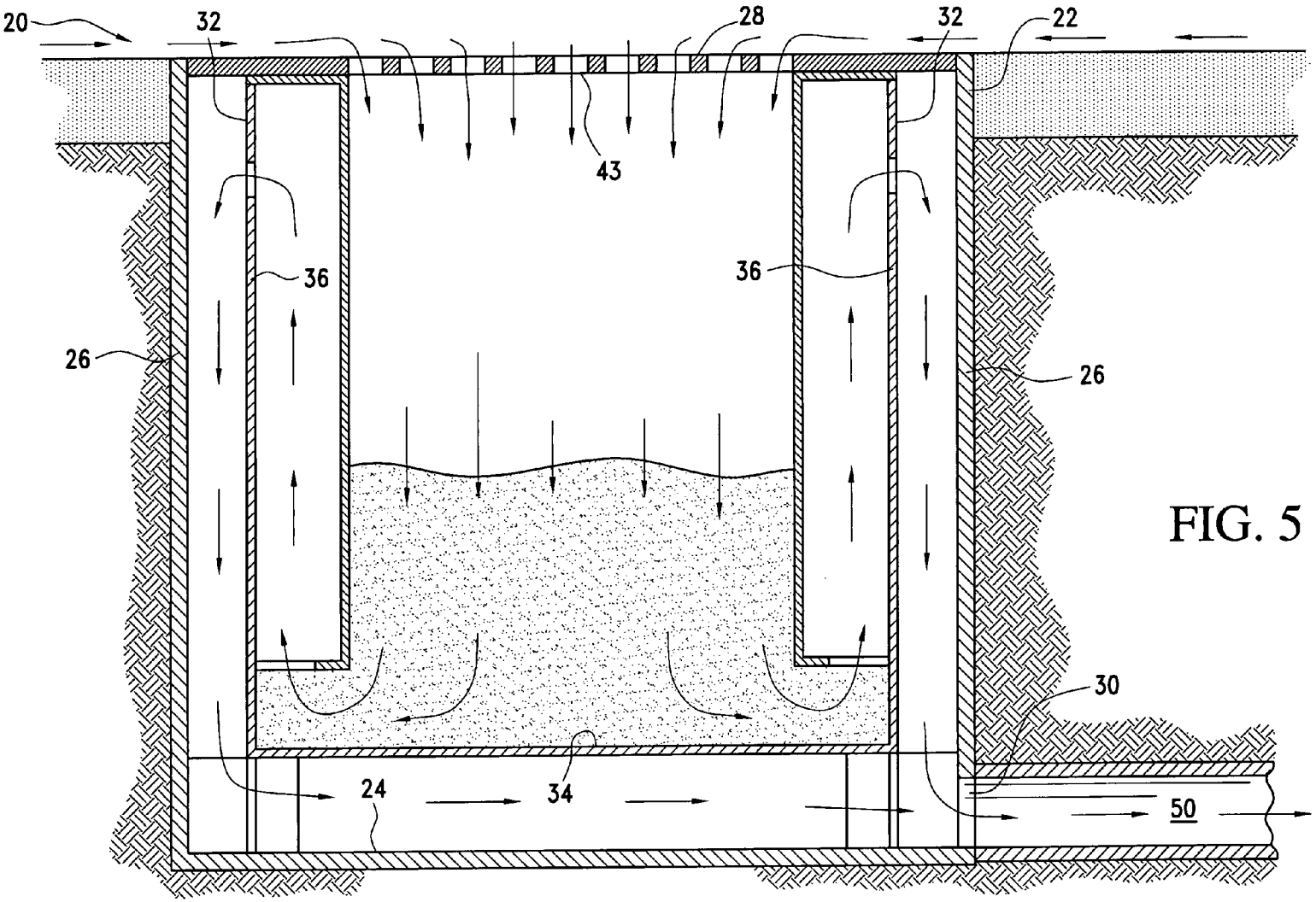
FIG. 5 is a cross-sectional view illustrating the water flow in a ground water collection system in accordance with the invention.

The system 20 also includes an inner housing 42 having four water impermeable sides 44 with an open top 43 and open bottom 45. The housing 42 also includes an outwardly extending upper flange 46 around the top or upper periphery and a lower outwardly extending flange 48 with a plurality of semi-circular openings 49 therein. The lower flange 48 is generally parallel with the upper flange 46 which extends between the inner housing 42 and receptacle 32 and prevents ground water from the grate 28 from passing into the space between the inner housing 42 and receptacle 32. The lower flange 48 also extends outwardly from the inner housing 42 to the receptacle 32 and helps position the inner housing 42 within the receptacle 32, but because of the openings, it allows ground water that has passed through the inner housing to the bottom of basin 22 to flow upwardly between the side walls 36 of the receptacle 32 and sides 44 of the inner housing 42. The ground water then flows out of the generally rectangular springs 38 and down to the bottom of the basin 22 and into a sewer line 50 (FIGS. 4 and 5). A plurality of spacers 45 is attached to the sides 44 of the inner housing 42 and between the upper flange 46 and lower flange 48 for additional support of the flanges. These spacers are preferably fixed to the sides of the inner housing.

The system is considered to be particularly applicable to forward locations that are surrounded by sandy soil wherein large amounts of sand tend to fill underground basins and must be periodically cleaned. In such areas the present invention facilitates removable of accumulated sand, dirt and other debris from the basin and at the same time uses the accumulated sand to filter the water that reaches the sewer.

While the invention has been described in connection with its preferred embodiment, it should be recognized that changes and modifications maybe made therein without departing from the scope of appended claims.

What is claimed is:

1. A storm water collection system comprising:

a below ground water receiving basin having four sides and a bottom, a grate disposed above said basin for allowing ground water to run into said basin and an outlet for transferring water from said basin into a sewer line;

a removable box-like receptacle disposed in said basin with a space on each side thereof, and means for directing surface run off water into said receptacle and said receptacle including a water impermeable bottom including means for supporting said bottom of said receptacle above said bottom of said basin and four upwardly extending water impermeable sides having upper and lower portions and an open tap with a handle in a upper portion of two of said water impermeable sides for facilitating removal of said receptacle from said basin;

a longitudinally extending generally rectangular opening in said upper portion of each of said sides for allowing accumulated water to pass through said openings and down between said sides of said receptacle and said basin to the bottom of said basin; and an inner housing having four water impermeable sides with an open top and an open bottom and with an outwardly extending upper flange extending around said inner housing and an outwardly extending lower flange with a plurality of openings therein extending around said inner housing, and said inner housing extending near the top of said receptacle to said lower portion of said side walls of said receptacle above said bottom of said receptacle and said upper flange extending over said side walls of said receptacle and said lower flange extending between said side walls of said receptacle and said inner housing to thereby define passageways from near the bottom of said receptacle which is relatively free of dirt and debris upwardly to said longitudinally extending generally rectangular openings and out of said receptacle and into said basin.

2. A storm water collection system comprising:

a below ground water receiving basin having four sides and a bottom, a grate disposed above said basin for allowing ground water to run into said basin and an outlet for transferring water from said basin into a sewer line;

a removable box-like receptacle disposed in said basin with a space on each side thereof, and means for directing surface run off water into said receptacle and said receptacle including a water impermeable bottom including means for supporting said bottom of said receptacle above said bottom of said basin and four upwardly extending water impermeable sides having upper and lower portions and an open tap with a handle in a upper portion of two of said water impermeable sides for facilitating removal of said receptacle from said basin;

a longitudinally extending generally rectangular opening in said upper portion of each of said sides for allowing accumulated water to pass through said openings and down between said sides of said receptacle and said basin to the bottom of said basin; and an inner housing having four water impermeable sides with an open top and an open bottom and with an outwardly extending upper flange extending around said inner housing and an outwardly extending lower flange with a plurality of openings therein extending around said inner housing, and said inner housing extending near the top of said receptacle to said lower portion of said side walls of said receptacle above said bottom of said receptacle and said upper flange extending over said side walls of said receptacle and said lower flange extending between said side walls of said receptacle and said inner housing to thereby define passageways from near the bottom of said receptacle which is relatively free of dirt and debris upwardly to said longitudinally extending generally rectangular openings and out of said receptacle and into said basin and which includes spacer beams for positioning said receptacle at a distance from each of said four sides of said basin.

3. A storm water collection system comprising:

a below ground water receiving basin having four sides and a bottom, a grate disposed above said basin for allowing ground water to run into said basin and an outlet for transferring water from said basin into a sewer line;

a removable box-like receptacle disposed in said basin with a space on each side thereof, and means for directing surface run off water into said receptacle and said receptacle including a water impermeable bottom including means for supporting said bottom of said receptacle above said bottom of said basin and four upwardly extending water impermeable sides having upper and lower portions and an open tap with a handle in a upper portion of two of said water impermeable sides for facilitating removal of said receptacle from said basin;

a longitudinally extending generally rectangular opening in said upper portion of each of said sides for allowing accumulated water to pass through said openings and down between said sides of said receptacle and said basin to the bottom of said basin; and an inner housing having four water impermeable sides with an open top and an open bottom and with an outwardly extending upper flange extending around said inner housing and an outwardly extending lower flange with a plurality of openings therein extending around said inner housing, and said inner housing extending near the top of said receptacle to said lower portion of said side walls of said receptacle above said bottom of said receptacle and said upper flange extending over said side walls of said receptacle and said lower flange extending between said side walls of said receptacle and said inner housing to thereby define passageways from near the bottom of said receptacle which is relatively free of dirt and debris upwardly to said longitudinally extending generally rectangular openings and out of said receptacle and into said basin and which includes spacer beams for positioning said receptacle at a distance from each of said four sides of said basin which includes two longitudinally extending generally rectangular openings in said upper portion of each of said sides of said receptacle.

4. A storm water collection system according to claim 3 in which said upper flange and said inner housing are made of a metal.

5. A storm water collection system according to claim 4 in which said upper flange on said inner housing extends over said four upwardly extending water impermeable sidewalls of said receptacle.

6. A storm water collection system according to claim 5 in which said lower flange of said inner housing has a plurality of relatively large semi-circular openings that extend inwardly towards said inner housing by a distance of at least ½ of the width of said lower flange.

7. A storm water collection system according to claim 6 in which said inner housing includes a support member extending along each of said four sides of said inner housing between said upper and said lower flanges and rigidly fastened to each flange and one of said sides for structure support of said inner housing.

* * * * *